US011404020B2

(12) United States Patent
Liu

(10) Patent No.: US 11,404,020 B2
(45) Date of Patent: Aug. 2, 2022

(54) DRIVING CIRCUIT AND LIQUID CRYSTAL DISPLAY DEVICE

(71) Applicant: TCL CHINA STAR OPTOELECTRONICS TECHNOLOGY CO., LTD., Shenzhen (CN)

(72) Inventor: Jinfeng Liu, Shenzhen (CN)

( * ) Notice: Subject to any disclaimer, the term of this patent is extended or adjusted under 35 U.S.C. 154(b) by 194 days.

(21) Appl. No.: 16/627,304

(22) PCT Filed: Dec. 10, 2019

(86) PCT No.: PCT/CN2019/124385

§ 371 (c)(1),
(2) Date: Dec. 29, 2019

(87) PCT Pub. No.: WO2021/103138

PCT Pub. Date: Jun. 3, 2021

(65) Prior Publication Data

US 2021/0358447 A1 Nov. 18, 2021

(30) Foreign Application Priority Data

Nov. 27, 2019 (CN) ..... 201911184061.7

(51) Int. Cl.
*G09G 3/36* (2006.01)
*G09G 3/20* (2006.01)

(52) U.S. Cl.
CPC ..... *G09G 3/3696* (2013.01); *G09G 3/2007* (2013.01); *G09G 2310/0243* (2013.01); *G09G 2310/08* (2013.01); *G09G 2320/0276* (2013.01); *G09G 2320/0673* (2013.01)

(58) Field of Classification Search
CPC ..... G09G 3/3696; G09G 3/2007; G09G 2310/08; G09G 2320/0276; G09G 2320/0673; G09G 2310/0243
See application file for complete search history.

(56) References Cited

U.S. PATENT DOCUMENTS 7,667,677 B2 * 2/2010 Yi ..... G02F 1/13452 345/204
7,724,225 B2 * 5/2010 Yi ..... G09G 3/20 345/99

(Continued)

FOREIGN PATENT DOCUMENTS

CN 102598101 A 7/2012
CN 103426409 A 12/2013

(Continued)

*Primary Examiner* — Michael J Jansen, II

(57) ABSTRACT

The present disclosure provides a driving circuit and a liquid crystal display device. The driving circuit is configured to drive the liquid crystal to display and includes liquid crystal driving chips configured to receive original Gamma voltage; a time sequence control chip configured to receive the original Gamma voltages transmitted by the liquid crystal driving chips and output Gamma voltage adjust correcting parameters to the liquid crystal driving chips; the liquid crystal driving chip compensating and correcting the original Gamma voltage according to the Gamma voltage adjust correcting parameters to make Gamma voltages of each of the liquid crystal driving chips equal.

7 Claims, 2 Drawing Sheets

(56) References Cited

U.S. PATENT DOCUMENTS

| | | | | |
|---|---|---|---|---|
| 7,898,518 | B2 * | 3/2011 | Hong | G09G 3/3611 345/99 |
| 7,936,330 | B2 * | 5/2011 | Park | G09G 3/3611 345/99 |
| 8,212,803 | B2 * | 7/2012 | Hong | G09G 3/3648 345/87 |
| 8,570,268 | B2 * | 10/2013 | Sheu | G09G 3/3611 345/100 |
| 9,087,474 | B2 * | 7/2015 | Seong | G09G 1/005 |
| 9,384,699 | B2 * | 7/2016 | Park | G09G 3/3266 |
| 9,892,686 | B2 * | 2/2018 | Xu | G09G 3/3258 |
| 10,170,037 | B2 * | 1/2019 | Choi | G09G 3/3233 |
| 10,593,250 | B2 * | 3/2020 | Zeng | G09G 3/2007 |
| 10,643,537 | B2 * | 5/2020 | Kwon | H01L 27/3211 |
| 11,056,038 | B2 * | 7/2021 | Xu | G09G 3/20 |
| 11,069,301 | B2 * | 7/2021 | Cho | G09G 3/3685 |
| 11,145,236 | B2 * | 10/2021 | Baek | G09G 3/2007 |
| 2006/0202935 | A1 * | 9/2006 | Yi | G09G 3/20 345/98 |
| 2006/0244708 | A1 * | 11/2006 | Yi | G09G 3/3611 345/98 |
| 2007/0132791 | A1 * | 6/2007 | Yi | G09G 5/006 345/690 |
| 2010/0026732 | A1 | 2/2010 | Otawara | |
| 2010/0149082 | A1 * | 6/2010 | Hong | G09G 3/3611 345/88 |
| 2010/0149083 | A1 * | 6/2010 | Park | G09G 3/3611 345/99 |
| 2010/0156879 | A1 * | 6/2010 | Hong | G09G 3/3648 345/213 |
| 2011/0057915 | A1 * | 3/2011 | Sheu | G09G 3/3611 345/211 |
| 2012/0169700 | A1 | 7/2012 | Mori | |
| 2013/0088477 | A1 * | 4/2013 | Seong | G09G 3/3696 345/211 |
| 2014/0198090 | A1 * | 7/2014 | Park | G09G 3/3291 345/82 |
| 2016/0189628 | A1 * | 6/2016 | Choi | G09G 3/3233 345/77 |
| 2017/0140705 | A1 * | 5/2017 | Xu | G09G 3/2003 |
| 2017/0330521 | A1 | 11/2017 | Zhao et al. | |
| 2018/0182277 | A1 * | 6/2018 | Zeng | G09G 3/2007 |
| 2018/0190196 | A1 * | 7/2018 | Kwon | H01L 27/3211 |
| 2018/0210261 | A1 | 7/2018 | Chen | |
| 2019/0197964 | A1 * | 6/2019 | Cho | G09G 3/3275 |
| 2020/0258443 | A1 * | 8/2020 | Xu | G09G 3/20 |
| 2021/0118352 | A1 * | 4/2021 | Baek | G09G 3/2007 |
| 2021/0358447 | A1 * | 11/2021 | Liu | G09G 3/3696 |

FOREIGN PATENT DOCUMENTS

| | | | |
|---|---|---|---|
| CN | 103474016 | A | 12/2013 |
| CN | 105118423 | A | 12/2015 |
| CN | 106297721 | A | 1/2017 |
| EP | 2149868 | A2 | 2/2010 |

* cited by examiner

DRIVING CIRCUIT AND LIQUID CRYSTAL DISPLAY DEVICE

FIELD OF INVENTION

The present disclosure related to the field of the display technologies, particularly to a driving circuit and a liquid crystal display device.

BACKGROUND OF INVENTION

Liquid crystal displays (LCDs) are common and popular electronic devices due to advantages such as low power consumption, small size, light weight, etc. A number of required liquid crystal driving chips grows with the larger size of the liquid crystal panel accompany with upgraded consumer requirement and technology development. A Gamma voltage generating module is required for generating Gamma voltages and transmitting the Gamma voltages to each of the liquid crystal driving chips. However, variations and voltage drops of the Gamma voltages occur during transmission due to different distances between the liquid crystal driving chip and the Gamma voltage generating module, thereby display images of the liquid crystal panel are uneven.

Therefore, drawbacks existing in the present technologies are urgently required improvements.

Technical Problems

The present disclosure provides a driving circuit and a liquid crystal display device to improve unevenness of images displayed by the liquid crystal panel.

SUMMARY OF INVENTION

To solve the above problems, the present disclosure provides the following technical solutions.

The present disclosure provides a driving circuit configured to drive a liquid crystal panel, comprising:

Liquid crystal driving chips, wherein at least two of the liquid crystal driving chips arranged in an one-dimensional array, and the liquid crystal driving chips are configured to receive original Gamma voltages and are electrically connected to pixel circuits in a display region of the liquid crystal panel.

A time sequence control chip electrically connected to the liquid crystal driving chips, configured to receive the original Gamma voltages transmitted by the liquid crystal driving chips, and configured to output Gamma voltage correcting parameters to the liquid crystal driving chips.

The liquid crystal driving chips compensate and adjust the original Gamma voltages according to the Gamma voltage correcting parameters to make Gamma voltages of the liquid crystal driving chips equal, and adjusted Gamma voltages are transmitted to the pixel circuits to drive the liquid crystal panel to display.

In the driving circuit of the present disclosure, each of the liquid crystal driving chips is electrically connected to the time sequence control chip through P2P wires, and each of the liquid crystal driving chips transmits the original Gamma voltage to the time sequence control chip through differential pair of the P2P wires after receiving the original Gamma voltage.

In the driving circuit of the present disclosure, the time sequence control chip includes a Gamma voltage correcting module configured to generate the Gamma voltage correcting parameters by comparing the original Gamma voltages received by the time sequence control chip from different liquid crystal driving chips.

In the driving circuit of the present disclosure, the liquid crystal driving chip includes a Gamma voltage adjusting module configured to adjust the original Gamma voltages according to the Gamma voltage correcting parameters to generate the adjusted Gamma voltages.

In the driving circuit of the present disclosure, the array grouped by the at least two of the liquid crystal driving chips includes a near-end liquid crystal driving chip located in a central area and a far-end liquid crystal driving chip located by the near-end liquid crystal driving chip, and the time sequence control chip is disposed correspondingly to a location of the near-end liquid crystal driving chip.

In the driving circuit of the present disclosure, the near-end liquid crystal driving chip lowers a corresponding one of the original Gamma voltages according to the Gamma voltage correcting parameters to make the Gamma voltages of the near-end liquid crystal driving chip and the Gamma voltages of the far-end liquid crystal driving chip be equal.

To solve the problems above, the present disclosure further provides a liquid crystal display device comprising the above-mentioned liquid crystal panel and the driving circuit. The driving circuit is disposed on one side of the liquid crystal panel, and the liquid crystal driving chips of the driving circuit are electrically connected to signal wires of the liquid crystal panel.

In the liquid display device of the present disclosure, the liquid crystal panel comprises printed circuit boards arranged in segments and disposed at one side of the liquid crystal panel, and the liquid crystal driving chips arranged in an one-dimensional array and disposed on the printed circuit board.

In the liquid display device of the present disclosure, each one of the printed circuit board is provide with a port, and the ports of two adjacent one of the printed circuit boards are electrically connected to each other through a flexible wire.

The present disclosure further provides a driving circuit configured to drive a liquid crystal panel, comprising:

Liquid crystal driving chips, wherein at least two of the liquid crystal driving chips arranged in an one-dimensional array, and the liquid crystal driving chips are configured to receive original Gamma voltages and are electrically connected to pixel circuits in a display region of the liquid crystal panel.

A Gamma voltage generating module configured to generate the original Gamma voltages and configured to output the original Gamma voltages to the liquid crystal driving chips.

A time sequence control chip electrically connected to the liquid crystal driving chips, configured to receive the original Gamma voltages transmitted by the liquid crystal driving chips, and configured to output Gamma voltage correcting parameters to the liquid crystal driving chips.

The liquid crystal driving chips compensate and adjust the original Gamma voltages according to the Gamma voltage correcting parameters to make Gamma voltages of the liquid crystal driving chips equal, and adjusted Gamma voltages are transmitted to the pixel circuits to drive the liquid crystal panel to display.

In the driving circuit of the present disclosure, each of the liquid crystal driving chips is electrically connected to the time sequence control chip through P2P wires, each of the liquid crystal driving chips differentially transmits the original Gamma voltage to the time sequence control chip through differential pair of the P2P wires after receiving the original Gamma voltage.

In the driving circuit of the present disclosure, each of the liquid crystal driving chips is electrically connected to the time sequence control chip through P2P wires, each of the liquid crystal driving chips differentially transmits the original Gamma voltage to the time sequence control chip through differential pair of the P2P wires after receiving the original Gamma voltage.

In the driving circuit of the present disclosure, the time sequence control chip includes a Gamma voltage correcting module configured to generate the Gamma voltage correcting parameters by comparing the original Gamma voltages received by the time sequence control chip from different liquid crystal driving chips.

In the driving circuit of the present disclosure, the liquid crystal driving chip includes a Gamma voltage adjusting module configured to adjust the original Gamma voltages according to the Gamma voltage correcting parameters to generate the adjusted Gamma voltage.

In the driving circuit of the present disclosure, the array grouped by the at least two of the liquid crystal driving chips includes one near-end liquid crystal driving chip located in a central area and one far-end liquid crystal driving chip laterally located by the near-end liquid crystal driving chip, and the time sequence control chip is disposed correspondingly to a location of the near-end liquid crystal driving chip.

In the driving circuit of the present disclosure, the near-end liquid crystal driving chip lowers a corresponding one of the original Gamma voltage according to the Gamma voltage correcting parameters to make the Gamma voltages of the near-end liquid crystal driving chip and the Gamma voltages of the far-end liquid crystal driving chip being equal.

Beneficial Effect

The beneficial effect of the present disclosure is: the driving circuit and the liquid crystal display device of the present disclosure transmit voltage signals through differential P2P wires to the time sequence control chip after the liquid crystal driving chips receive the original Gamma voltages on the basis of characteristics of dual-direction communication of P2P transmission protocol. The time sequence control chip outputs the voltage correcting parameters to the liquid crystal driving chip through an internal correction mechanism. The liquid crystal driving chip adjusts and corrects the original Gamma voltages internally, so that the Gamma voltages of each the liquid crystal driving chips are adjusted to equal. As a result the problem of uneven display caused by the large impedance of the flexible printed circuit (FPC) in the large-size liquid crystal panel can effectively be solved.

DETAILED DESCRIPTION OF PREFERRED EMBODIMENTS

Figure 1:
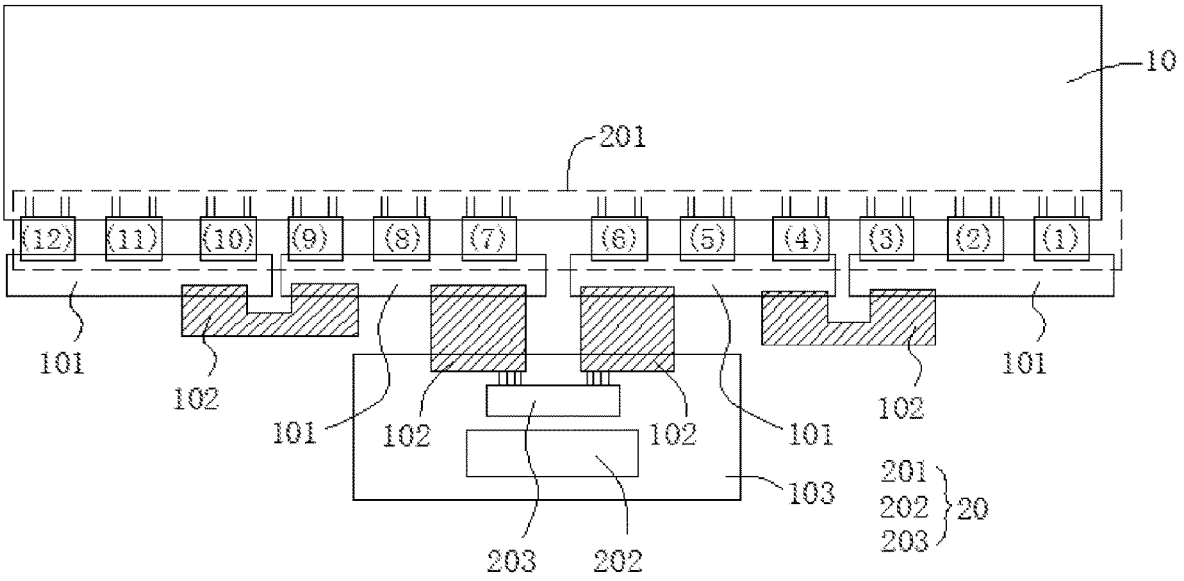
FIG. 1 illustrates a structural diagram of a liquid display device of an embodiment of the present disclosure.

The following description of the various embodiments is provided with reference of drawings to illustrate specific embodiments. Directional terms mentioned in the present disclosure, such as upper, lower, front, back, left, right, inside, outside, lateral, etc., are only referring to the direction of the drawing. Therefore, the directional terms used to describe and clarify the present disclosure should not be viewed as limitations of the present disclosure. In the drawing, structurally similar elements are denoted by the same reference numbers.

Variations and voltage drops of Gamma voltages occur during transmission, thereby display images of a liquid crystal panel are uneven. These problems can be solved by the embodiments of the present disclosure.

FIG. 1 illustrates a structural diagram of a liquid display device of an embodiment of the present disclosure.

The liquid crystal display device includes a liquid crystal panel 10 and driving circuits 20. The display region of the liquid crystal panel 10 is provided with pixel circuits (not shown). The driving circuit 20 is disposed on one side of the display region of the liquid crystal panel 10. The liquid crystal panel 10 includes a plurality of the printed circuit boards 101 disposed in segments on one side of the liquid crystal panel 10. The plurality of the printed circuit boards 101 are arranged in a one-dimensional array. The printed circuit board 101 is provided with interface terminals (not shown), and two adjacent on of the printed circuit board 101 are electrically connected to the interface terminal through a flexible circuit 102 to implement electrical connection between two of the printed circuit board 101. The driving circuit 20 includes liquid crystal driving chips 201, a time sequence control chip 202, and a Gamma voltage generating module 203.

The Gamma voltage generating module 203 is connected to the liquid crystal driving chips 201.

The Gamma voltage generating module 203 is configured to generate the original Gamma voltages and configured to output the original Gamma voltages to the liquid crystal driving chips 201. The liquid crystal driving chip 201 is electrically connected to pixel circuits in the display region of the liquid crystal panel 10 and is electrically connected to the time sequence control chip 202. The liquid crystal driving chips 201 are utilized to transmit the original Gamma voltage to the time sequence control chip 202. The time sequence control chip 202 is configured to transmit adjusting parameters of the original Gamma voltages, received by time sequence control chip 202, to the liquid crystal driving chips 201. The liquid crystal driving chips 201 are configured to correct the original Gamma voltages. The liquid crystal driving chips 201 are configured to transmit the corrected Gamma voltages to the pixel circuits to drive the liquid crystal panel 10 to display.

The liquid crystal display device of the present application is described below with reference to specific embodiments.

In one embodiment, at least one of the liquid crystal driving chip 201 is provided on the printed circuit board 101. For convenience of description, only four of the printed circuit boards 101 are shown in FIG. 1 and each of the printed circuit board 101 is equipped with three of the liquid crystal driving chip 201, which is not limited in the actual manufacturing processes.

At least two of the liquid crystal driving chips 201 are arranged in the one-dimensional array, and are disposed on the printed circuit board 101 which is arranged in segments The chip array grouped by the at least two of the liquid crystal driving chips 201 includes one near-end liquid crystal driving chip and one located far-end liquid crystal driving chip. The near-end liquid crystal driving chip locates in a central area. The far-end liquid crystal driving chip laterally locates by the near-end liquid crystal driving chip.

For the convenience of description, the liquid crystal driving chip 201 is ordered from (1) to (12) from right to left. The liquid crystal driving chip 201 (1) is the first at the right, consequently, the liquid crystal driving chip 201 (12) is the leftist one. In an example of this embodiment, the liquid crystal driving chip 201 (4)~201 (9) on the printed circuit board 101 in the middle are viewed as the near-end liquid crystal driving chips, and the remaining liquid crystal driving chip 201 (1)~201 (3), 201 (10)~201 (12) are views as far-end the liquid crystal driving chips.

The time sequence control chip 202 and the Gamma voltage generating module 203 are disposed on a first circuit board 103 corresponding to the liquid crystal driving chip 201(4)-201 (9). The first circuit board 103 is disposed on one side of the printed circuit board 101 far away from the liquid crystal panel 10. The near-end liquid crystal driving chips 201(4)-(9) are connected to at least one of the printed circuit board 101 and connected to the first circuit board 103 through the flexible wires 102.

Material of the first circuit board 103 is not limited by the present disclosure. The materials of the first circuit board 103 and the printed circuit board 101 can be the same. The material of the first circuit board 103 also can be a flexible circuit board. In the meanwhile, a number of the near-end liquid crystal driving chips and a number of the far-end liquid crystal driving chips can be determined according to accrual manufacturing processes and distance with the Gamma voltage generating module 203, which are not limited hereby.

The Gamma voltage generating module 203 is configured to generate the original Gamma voltages and configured to output the original Gamma voltages to different one of the liquid crystal driving chips 201. In this embodiment, the Gamma voltage generating module 203 divides the original Gamma voltages to two parts and respectively transmits each parts of the original Gamma voltages to two one of the printed circuit board 101. The two printed circuit board 101 input the original Gamma voltage to the corresponding to the liquid crystal driving chips 201 in sequence from middle to two sides. That is, the original Gamma voltage are transmitted to the difference one of the liquid crystal driving chips 201 in sequence from middle to two sides.

The signals are connected between the two printed circuit boards 101 through the flexible circuit 102. However, the flexible circuit 102 has its own impedance and the contact impedance of the superimposed interface terminal. The total impedance can reach about 6 ohms. As a result, voltage drops across two ends of the Gamma voltages on the flexible circuit 102 is large, thus the Gamma voltages change, and thereby the problem of uneven display of the screen occurs.

In response to this problem, each of the liquid crystal driving chip 201 is electrically connected to the time sequence control chip 202 through P2P wires. Each of the liquid crystal driving chips 201 receives the original Gamma voltages. Then, the original Gamma voltage is transmitted back to the time sequence control chip 202 through a differential pair of the P2P wires. This transmission method does not cause voltage loss.

Figure 2:
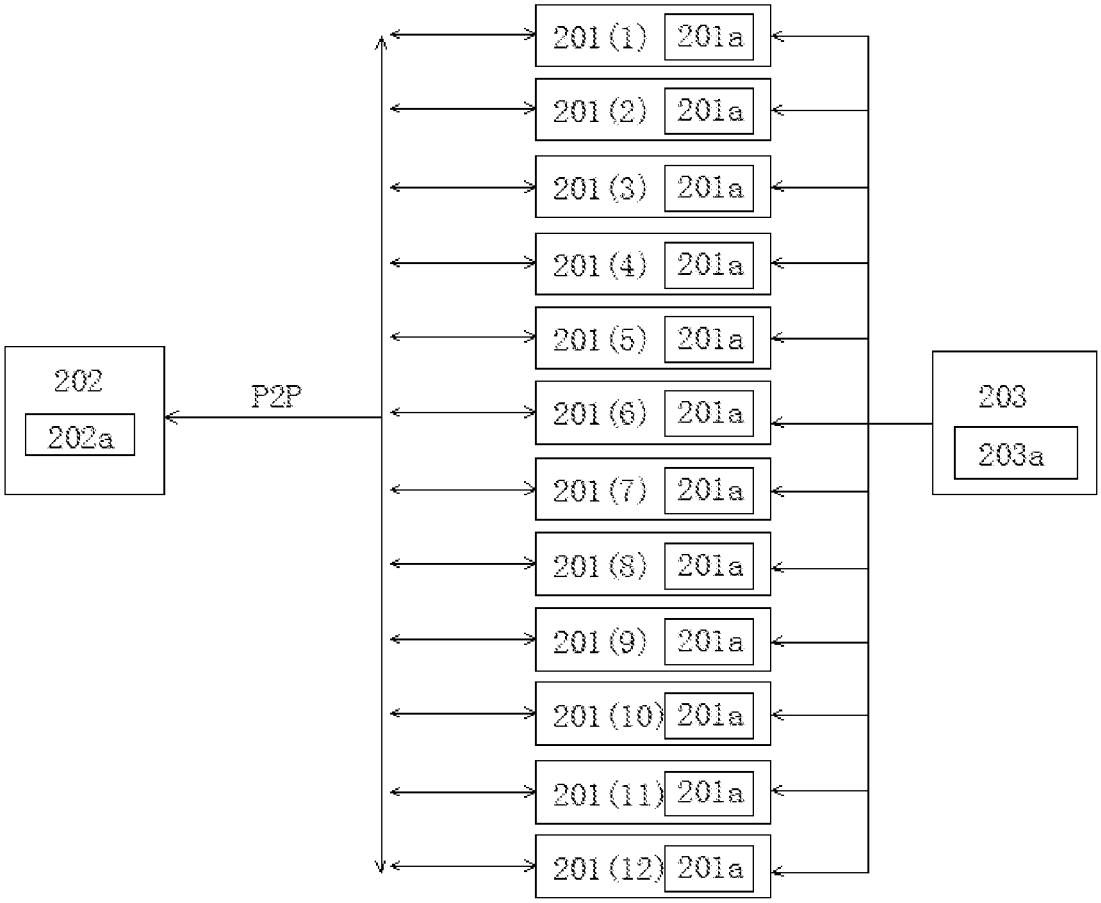
FIG. 2 illustrates a diagram of Gamma voltage adjustment of a driving circuit shown in FIG. 1.

In this embodiment, based on the characteristics of the P2P transmission protocol which can communicate in dual directions, P2P wires are adopted to the electrical connection between the liquid crystal driving chip 201 and the time sequence control chip 202. Specifically, as shown in FIG. 2, the Gamma voltage generating module 203 transmits the original Gamma voltage to the liquid crystal driving chips 201 (1)-201(12). During the transmission, the original Gamma voltages transmitted to the different liquid crystal driving chips 201 (1)-(12) are different (various) due to the impedance of the flexible circuit 102 itself and the contact impedance of the interface terminal. After the liquid crystal driving chips 201 (1)-(12) receive the original Gamma voltages, the original Gamma voltages are transmitted back to the time sequence control chip 202 through differential pairs of the P2P wires.

The time sequence control chip 202 includes a Gamma voltage correcting module 202*a*, and the Gamma voltage correction module 202*a* is configured to compare the different original Gamma voltages received by the time sequence control chip 202 from the liquid crystal driving chips 201(1)-(12), and configured to generate a Gamma voltage correcting parameter.

The time sequence control chip 202 transmits the Gamma voltage correcting parameters to the corresponding liquid crystal driving chips 201(1)~(12) through the P2P wires. The liquid crystal driving chips 201 (1)-(12) of the present disclosure includes Gamma voltage adjusting modules 201*a*. The Gamma voltage adjusting modules 201*a* are utilized to adjust and correct the original Gamma voltages according to the Gamma voltage correcting parameters to generate adjusted Gamma voltages, thereby, the Gamma voltages of each of the liquid crystal driving chips 201 (1)-(12) are equal. The adjusted Gamma voltages are utilized to drive the liquid crystal panel to display. The liquid crystal driving chips 201 (1)~(12) are electrically connected to signal lines (not shown) provided in the liquid crystal panel 10. The signal line includes, but is not limited to, data lines.

The farther the transmission distance is, the larger affection of voltage drop is. That is, affections of the far-end liquid crystal driving chips 201 (1)-(3), (10)-(12) caused from voltage drops are larger than affections of the near-end liquid crystal driving chips 201 (4)-(9) caused from voltage drops. As a result, in this embodiment, according to the Gamma voltage adjusting parameters, the original Gamma voltages corresponding to the far-end liquid crystal driving chips 201 (1)-(3), (10)-(12) are lowered and the original Gamma voltages corresponding to the near-end liquid crystal driving chips 201 (4)-(9) are raised to make values of the original Gamma voltages of the d liquid crystal driving chips 201 (1)-(12) equal. Thus, unevenness of the liquid crystal panel 10 is solved.

In another embodiment, according to the Gamma voltage correcting parameters, the liquid crystal driving chips 201 sequentially lowers the values of the corresponding original Gamma voltages from the middle to the two ends until the voltage values off the original Gamma voltage of the farthest one of the liquid crystal driving chip 201 and nearest one of the liquid crystal driving chip 201 are equal.

In another embodiment, according to the Gamma voltage correcting parameters, the liquid crystal driving chips 201 sequentially raises the values of the corresponding original Gamma voltages from the two ends to the middle until the voltage values off the original Gamma voltage of the farthest one of the liquid crystal driving chip 201 and nearest one of the liquid crystal driving chip 201 are equal.

Figure 3:
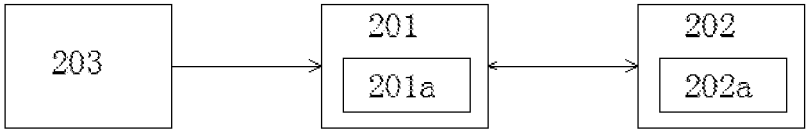
FIG. 3 illustrates a structural diagram of the driving circuit of the embodiment of the present disclosure.

In another embodiment, the Gamma voltage generating module 203 can locate on any one of the printed circuit boards 101, which is not limited herein. It should be noted that different one of the printed circuit boards 101 can space in the same distances or difference distances The present disclosure further provides a driving circuit utilized to drive the liquid crystal panel. As shown in FIG. 3, the driving circuit comprises the Gamma voltage generating module 203 configured to generate the original Gamma voltages and configured to output the original Gamma voltages. The liquid crystal driving chips are configured to receive original Gamma voltages and are configured transmit the time sequence control chip 202 through P2P transmission protocol. The time sequence control chip electrically is configured to receive the original Gamma voltages transmitted by different one of the liquid crystal driving chips 201, configured to compare the original Gamma voltages of different one of the liquid crystal driving chips 201 through the internal Gamma voltage correcting module 202*a*, and configured to generate the Gamma voltage correcting parameters. The time sequence control chip 202 is configured to output Gamma voltage correcting parameters to the liquid crystal driving chips 201. The Gamma voltage adjusting modules 201*a* disposed in liquid crystal driving chips 201 adjust and correct the original Gamma voltages according to the Gamma voltage correcting parameters. The adjusted Gamma voltages are generated so that Gamma voltages of each of the liquid crystal driving chips 201. Gama voltage driving signals are obtained according to the Gamma voltages. The Gama voltage driving signals are utilized to drive the liquid crystal panel to display.

Please refer to the above description illustrating liquid crystal display device for details to obtain the driving circuit, which will not be repeated here. In addition, because the present disclosure implements signal transmission based on the P2P transmission protocol which can achieve "point-to-point" transmission, that is, it can accurately match in the process of dual-direction transmission of signals. No transmission mistake of signals will occur, thus ensuring the reliability of Gamma voltage adjustment.

To conclude, although the present disclosure has been disclosed by above-mentioned preferred embodiments, the above-mentioned preferred embodiments are not limitations to the present disclosure. Variations and modifications can be obtained by a person skilled in the art without departing from the aspect and scope of the present disclosure. Therefore, the protected scope of the present disclosure is subject to the defined scope of claims.

What is claimed is:

1. A driving circuit configured to drive a liquid crystal panel, comprising:

a plurality of liquid crystal driving chips arranged in a one-dimensional array and connected to the liquid crystal panel;

wherein the plurality of liquid crystal driving chips comprise a near-end liquid crystal driving chip located in a central area of the driving circuit and a far-end liquid crystal driving chip located by the near-end liquid crystal driving chip, and the plurality of liquid crystal driving chips are configured to receive original Gamma voltages and are electrically connected to pixel circuits in a display region of the liquid crystal panel; and a time sequence control chip disposed on a first circuit board which is connected to the near-end liquid crystal driving chips through flexible wires, electrically connected to the liquid crystal driving chips, and configured to receive the original Gamma voltages transmitted by the liquid crystal driving chips, and configured to output Gamma voltage correcting parameters to the near-end liquid crystal driving chip;

wherein each of the liquid crystal driving chips is electrically connected to the time sequence control chip through P2P (point-to-point) wires, and each of the liquid crystal driving chips feedbacks a received original Gamma voltage to the time sequence control chip through a differential pair of the P2P wires after receiving the original Gamma voltage;

wherein the time sequence control chip comprises a Gamma voltage correcting module configured to generate the Gamma voltage correcting parameters by comparing the received original Gamma voltages received by the time sequence control chip from different liquid crystal driving chips; and wherein the near-end liquid crystal driving chip lowers a corresponding one of the original Gamma voltages according to the Gamma voltage correcting parameters to make the Gamma voltages of the near-end liquid crystal driving chip and the Gamma voltages of the far-end liquid crystal driving chip be equal.

2. The driving circuit according to claim 1, wherein the liquid crystal driving chip includes a Gamma voltage adjusting module configured to adjust the original Gamma voltages according to the Gamma voltage correcting parameters to generate the adjusted Gamma voltages.

3. A liquid crystal display device, comprising a liquid crystal panel and the driving circuit according to claim 1, wherein the driving circuit is disposed on one side of the liquid crystal panel, and the plurality of liquid crystal driving chips of the driving circuit are electrically connected to signal wires of the liquid crystal panel.

4. The liquid crystal display device according to claim 3, wherein the liquid crystal panel comprises printed circuit boards arranged in segments and disposed at one side of the liquid crystal panel, and the plurality of liquid crystal driving chips disposed on the printed circuit board.

5. The liquid crystal display device according to claim 4, wherein each one of the printed circuit board is provide with a port, and the ports of two adjacent one of the printed circuit boards are electrically connected to each other through a flexible wire.

6. A driving circuit configured to drive a liquid crystal panel, comprising:

a plurality of liquid crystal driving chips arranged in a one-dimensional array and connected to the liquid crystal panel;

wherein the plurality of liquid crystal driving chips comprise a near-end liquid crystal driving chip located in a central area of the driving circuit and a far-end liquid crystal driving chip located by the near-end liquid crystal driving chip, and the plurality of liquid crystal driving chips are configured to receive original Gamma voltages and are electrically connected to pixel circuits in a display region of the liquid crystal panel;

a Gamma voltage generating module configured to generate the original Gamma voltages and configured to output the original Gamma voltages to the liquid crystal driving chips; and a time sequence control chip disposed on a first circuit board which is connected to the near-end liquid crystal driving chips through flexible wires, electrically connected to the liquid crystal driving chips, and configured to receive the original Gamma voltages transmitted by the liquid crystal driving chips, and configured to output Gamma voltage correcting parameters to the near-end liquid crystal driving chip;

wherein each of the liquid crystal driving chips is electrically connected to the time sequence control chip through P2P wires, and each of the liquid crystal driving chips feedbacks a received original Gamma voltage to the time sequence control chip through differential pair of the P2P wires after receiving the original Gamma voltage;

wherein the time sequence control chip comprises a Gamma voltage correcting module configured to generate the Gamma voltage correcting parameters by comparing the received original Gamma voltages received by the time sequence control chip from different liquid crystal driving chips; and wherein the near-end liquid crystal driving chip lowers a corresponding one of the original Gamma voltages according to the Gamma voltage correcting parameters to make the Gamma voltages of the near-end liquid crystal driving chip and the Gamma voltages of the far-end liquid crystal driving chip be equal.

7. The driving circuit according to claim 6, wherein the liquid crystal driving chip comprises a Gamma voltage adjusting module configured to adjust the original Gamma voltages according to the Gamma voltage correcting parameters to generate the adjusted Gamma voltage.

* * * * *